United States Patent [19]

Metcalfe et al.

[11] Patent Number: 4,801,182

[45] Date of Patent: Jan. 31, 1989

[54] REFRIGERATOR DOOR STRUCTURE

[75] Inventors: L. D. Metcalfe, Royalton Township, Berrien County; Michael J. Maczuzak, Southfield; Curtis J. Bailey, Birmingham; Paul R. Deyo, Van Buren Township, Wayne County, all of Mich.

[73] Assignee: Whirlpool Corporation, Benton Harbor, Mich.

[21] Appl. No.: 136,026

[22] Filed: Dec. 21, 1987

[51] Int. Cl.[4] ..... 0000 00/00

[52] U.S. Cl. ..... 312/309

[58] Field of Search ..... 312/236, 138 A, 242, 312/348, 292, 311, 309, 292, 310, 293, 333

[56] References Cited

U.S. PATENT DOCUMENTS

| | | | |
|---|---|---|---|
| D. 122,760 | 9/1940 | Kruck . | |
| D. 154,963 | 8/1949 | Van Doren et al. . | |
| 1,128,477 | 2/1915 | McKee | 312/310 X |
| 2,237,820 | 4/1941 | Hill . | |
| 2,281,690 | 5/1942 | Hedlund . | |
| 2,330,044 | 9/1943 | Gaston | 312/293 |
| 2,825,617 | 3/1958 | Morgan . | |
| 2,840,434 | 6/1958 | Moore et al. | 312/309 X |
| 3,266,858 | 8/1966 | Klotz | 312/293 X |
| 3,371,926 | 3/1968 | Ritz | 312/348 X |
| 3,385,643 | 5/1968 | Adell | 312/348 |
| 3,469,211 | 9/1969 | Swaneck et al. | 312/138 A |
| 3,610,174 | 10/1971 | Kesling | 312/138 A X |
| 3,743,372 | 7/1973 | Ruggerone | 312/111 |
| 4,159,062 | 6/1979 | Levenhagen . | |
| 4,186,978 | 2/1980 | Thomson . | |
| 4,313,584 | 2/1982 | Fukunaga | 312/242 X |

*Primary Examiner*—Joseph Falk

*Attorney, Agent, or Firm*—Wood, Dalton, Phillips Mason & Rowe

[57] ABSTRACT

A refrigeration apparatus having a plurality of containers removably stored on the inner liner portion of the refrigeration apparatus door. A number of different forms of the containers is disclosed. The containers may be chosen by the user to have different desired heights and capacities commensurate with the user's needs. The containers are preferably formed of materials permitting their removal from the refrigerated environment to heating or serving environments, as desired. Releasable locking structure is provided for retaining the containers in association with the door, notwithstanding the normal movement thereof in the ordinary use of the refrigeration apparatus. In one form, shallow containers are utilized as covers.

14 Claims, 2 Drawing Sheets

REFRIGERATOR DOOR STRUCTURE

TECHNICAL FIELD

This invention relates to refrigeration apparatus and in particular to refrigerator door structures.

BACKGROUND ART

In one conventional form of refrigerator door, shelves are provided on the inner surface of the door for carrying objects to be refrigerated. One such shelf is adapted to receive egg holders which, for example, may support six or more eggs, and which holders may be removed as a unit with the eggs when desired.

Another form of prior art structure utilized in such refrigerator doors comprises a butter compartment wherein butter containers may be placed. It is conventional to provide a door over such a compartment so as to cause the temperature therein to be slightly higher than that of the remainder of the refrigerated space so as to retain the butter, or other spreadable material, at a desired softness.

It has further been conventional to provide the shelves on such refrigerator doors with a suitable configuration to accept side-by-side placement of canned products, such as soda pop.

It has further been conventional to provide containers of synthetic resin which may be stored in the refrigerator or freezer compartment, as desired. Such containers are conventionally provided with removable sealing covers.

Still further, it is conventional in refrigerators to provide crisper drawers and the like wherein metal or plastic containers are provided with removable covers or overlying shelf means and removably disposed within the refrigerated space inwardly of the door.

Still further, it is conventional, in such refrigerators, to provide ice cube forming means wherein ice cube trays are slidably placed on refrigerated shelves in the refrigerated space.

It has further been desirable to provide food containers which may be stored in the refrigerated space or freezer and which are adapted to be removed therefrom and utilized as the container in which the foodstuff or material is then heated in a convection oven or microwave oven, or the like.

DISCLOSURE OF INVENTION

The present invention comprehends an improved food storage means adapted to be associated with the inner, or liner, portion of the refrigerator space door for efficiently storing food materials, and the like, in the door while permitting the container to be readily removed and utilized for subsequent heating of the food material therein.

More specifically, the invention comprehends the provision of a food container having a removable cover adapted to be received in a housing means removably mounted to the door liner.

The housing means defines a pocket in which the food container is fitted for removable storage.

The housing means and food containers may be of different sizes and means may be provided on the door for selectively positioning the housing means in any one of a plurality of different positions, as desired.

Means are provided for releasably retaining the food container in the housing means against displacement by the normal movement of the door, while yet permitting facilitated insertion and removal of the food container means relative to the housing, when desired.

The container may be formed of suitable material capable of being transferred from the relatively cold environment of the refrigerated space to an oven, or the like, wherein the food material in the container may be heated, such as in the preparation thereof, for consumption purposes.

In one form, the door liner defines a plurality of horizontally extending slideways adapted to receive complementary flanges on the containers.

The slideways are adapted to receive a pair of such flanges in overlying relationship, whereby an inverted container may be utilized as a cover for an upwardly opening subjacent container carried on the slideway.

The containers may define outer handle portions for facilitated insertion and removal thereof relative to the slideways.

The invention comprehends the provision of container means adapted to be removably mounted to the door liner to provide for facilitated storage and heating of the food materials therein. Where no heating of the food material is required, the container may be utilized as a serving dish for transfer of the food material directly from the refrigerated space to the table.

More specifically, the invention comprehends the provision in a refrigeration apparatus door of housing means fixedly associated with an inner portion thereof defining a pocket for removably fittedly retaining a storage container on the door.

The invention comprehends the provision of a retaining means for removably fittedly retaining the storage container and mounting means for selectively mounting the retaining means in any one of a plurality of different positions on the refrigerator door inner portion for correspondingly removably retaining the containers in any one of the different positions.

The invention further comprehends the provision in a refrigeration apparatus of support means associated with the door inner portion and cooperating slide means on the container and support means for substantially horizontally slidably guiding the container to and from mounted association with the door.

The improved cooperating storage container refrigerator door structure of the present invention is extremely simple and economical of construction, while yet providing the substantially improved features discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
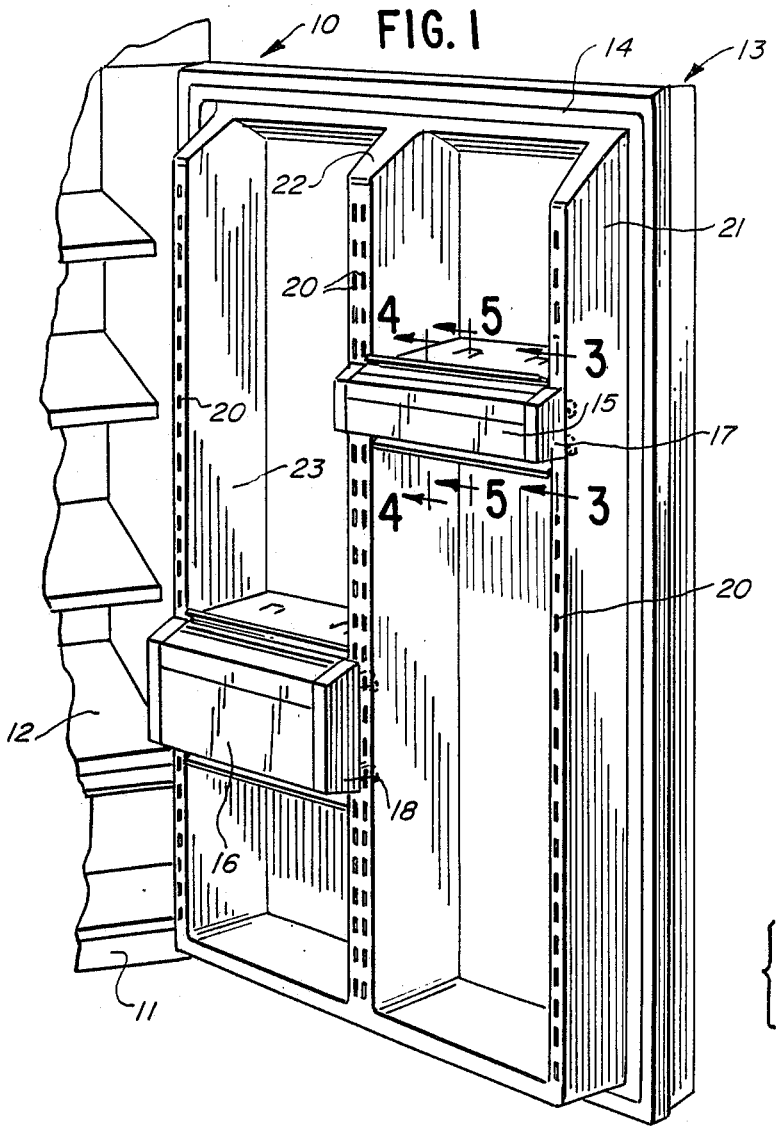
FIG. 1 is a fragmentary perspective view of a refrigerator door having storage container means embodying the invention.
Figure 3:
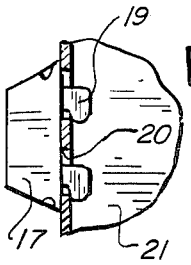
FIG. 3 is a fragmentary enlarged vertical section taken substantially along the line 3—3 of FIG. 1.
Figure 4:
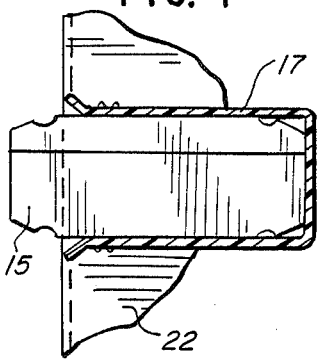
FIG. 4 is a fragmentary enlarged vertical section taken substantially along the line 4—4 of FIG. 1.
Figure 5:
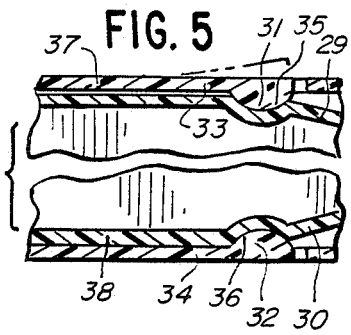
FIG. 5 is a fragmentary enlarged vertical section taken substantially along the line 5—5 of FIG. 1.

In the illustrative embodiment of the invention as disclosed in the drawing, a refrigeration apparatus generally designated 10 is shown to comprise a cabinet 11 defining a refrigerated space 12 selectively closed by a door generally designated 13. The door includes an inner liner portion 14 arranged to support a plurality of food containers, such as food containers 15 and 16. The food containers are removably installed in corresponding housings 17 and 18 effectively defining retaining means for removably retaining the food containers on the door in a storage disposition, as shown in FIG. 1.

The housings 17 and 18 are similar except that the housing 18 may have a greater vertical height than housing 17 to accommodate a container 16 having a height greater than that of container 15. The housings are removably mounted to the door 13 by a plurality of turned tongues 19 adapted to be received in vertically arrayed slots 20 in an inwardly projecting wall portion 21 of the door liner 14. A center wall 22 of the door liner may be provided with a pair of vertical rows of such slots 20, with the left-hand row cooperating with an array of slots 20 in a left-hand inwardly projecting wall 23, whereby two sets of vertically related containers may be mounted between the pairs of walls 21 and 22 and 22 and 23, respectively.

Any combination of different size or similar size housings and containers may be utilized on the door 13, as desired, as will be obvious to those skilled in the art. Each of the housings is provided with a pair of forwardly projecting handles 24 at opposite sides of the front opening 25 of the horizontally opening housing. The upper edge portion 26 and the lower edge portion 27 at the top and bottom of the front opening 25, respectively, are inclined so as to define guides for the facilitated insertion of the container 15 into the storage space 28 of the housing.

Similarly, the upper rear edge portion 29 and the lower rear edge portion 30 of the container 15 are angled so as to cooperate with bosses 31 and 32 carried on resiliently deflectible tongues 33 and 34 on the top wall 50 and bottom wall 51 of the housing, respectively. Upon full insertion of the container 15 into the housing pocket space 28, the bosses 31 and 32 spring into transverse grooves 35 and 36 in the top wall 37 and bottom wall 38 of the container 15.

A second set of such grooves 39 and 40, respectively, is provided at the opposite end of the top wall 37 and bottom wall 38, whereby the container may be inserted reversibly into the pocket 28 and retained in the housing by the bosses 31 and 32 releasably received in grooves 39 and 40.

As the portion of the container projecting outwardly from the housing 17 or 18 exposes the outer pair of such grooves, the grooves may be utilized as handle means accepting the user's fingers in moving the container inwardly and outwardly from the housing.

Figure 2:
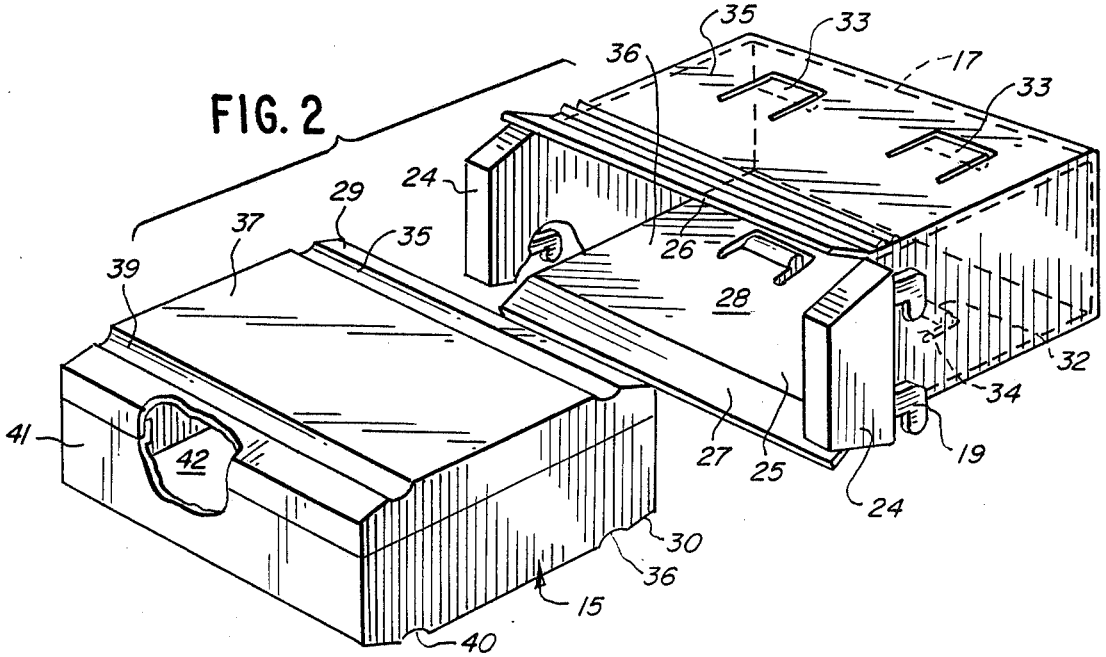
FIG. 2 is an exploded perspective view illustrating the relationship of the container and container support means.

As further shown in FIG. 2, the top wall 37 of the container 15 defines a cover removably mounted to the lower portion 41 thereof, thereby closing the food storage space 42 within the container.

The invention comprehends that the container be formed of a suitable material, permitting the transfer of the container from the refrigerated environment to heating means, such as an oven, when desired. Illustratively, the container 15 may be formed of a temperature-resistant synthetic resin, ceramic, glass, etc., within the broad scope of the invention.

While the invention has been disclosed with respect to containers exposed to the refrigerated space of a conventional refrigerator, as will be obvious to those skilled in the art, the provision of the storage means may be effected in connection with a freezer door, within the broad scope of the invention. As will be obvious to those skilled in the art, the material of which the containers are formed may be selected to accommodate the desired range of temperatures to be encountered in the intended use.

Figure 6:
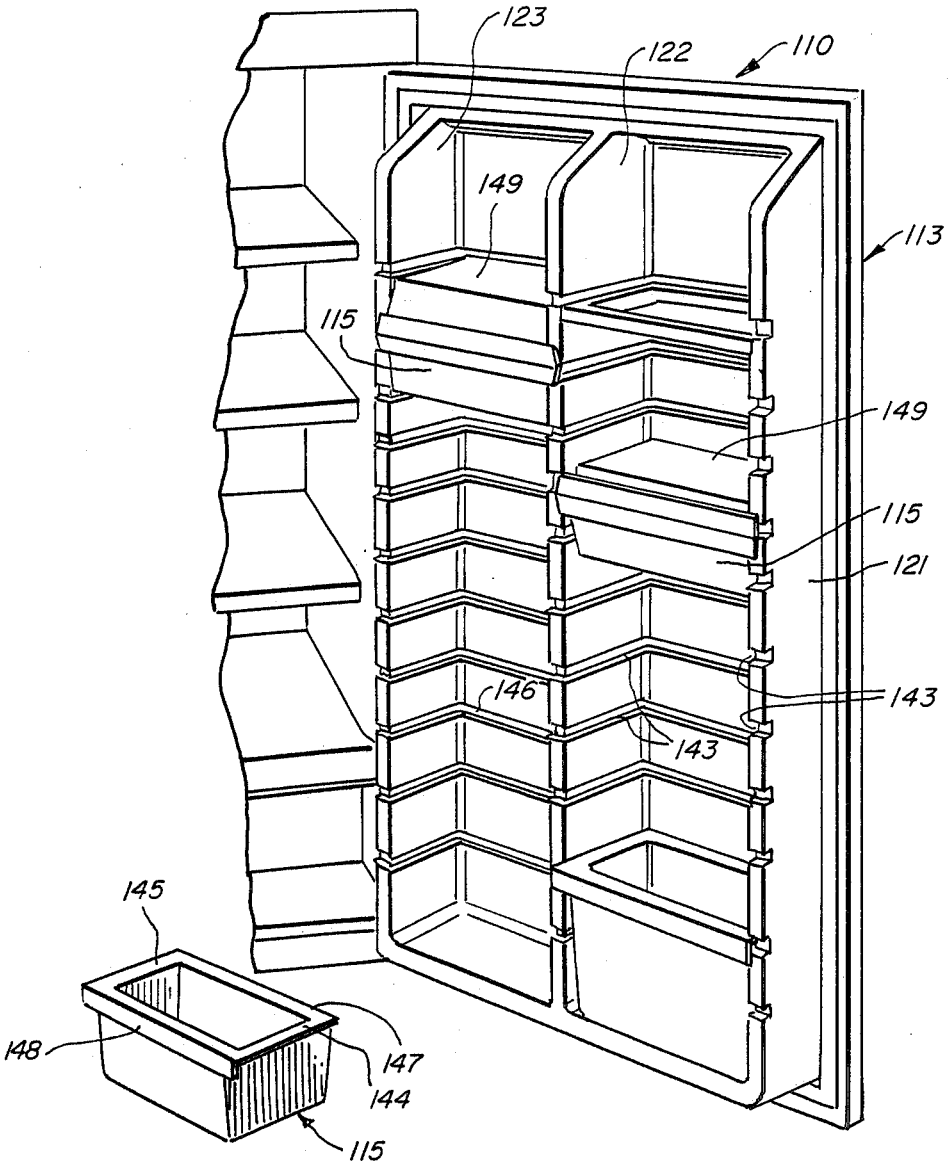
FIG. 6 is a fragmentary perspective view illustrating a modified form of a refrigerator door having storage means embodying the invention.

Referring now to the embodiment of FIG. 6, a modified form of refrigeration apparatus generally designated 110 is shown to comprise a refrigerator having a door 113 wherein the vertical walls 121, 122, and 123 are provided with horizontally extending confronting slots 143 in lieu of the tongue-accepting slots 20 of door 13. The containers 115 define laterally projecting upper flanges 144 and 145 adapted to be slidably received in the slots 143 for supporting the containers on any selected horizontally opposed pair of such slots on the walls 121, 122, and 123, respectively.

The door liner may be provided with transversely extending slots 146 extending between the side slots 143 to accommodate a rear flange 147 on the container. A depending front flange 148 serves as a handle for facilitating insertion and removal of the containers 115 into the spaces between the walls 121, 122, and 123, as seen in FIG. 6.

A shallow container 149, otherwise similar to container 115, may be utilized in an inverted position to serve as a cover for a subjacent container 115, with its side flanges slidably resting on the side flanges 144 and 145 of the subjacent container. Thus, any of the containers 115 may be covered by means of such inverted shallow containers 149, as desired. Advantageously the side slots 143 may be provided with recesses or grooves to receive mating bosses or projections on the containers, forming detents to releasably retain the containers in place on the door liner.

As will be obvious to those skilled in the art, the height of the different containers may be varied, as desired. The small cover containers 149 may be utilized also as upwardly opening containers for relatively low height items, such as butter, etc. Thus, a pair of the cover elements 149 may serve as a covered butter dish.

The containers 115 and 149 may be formed of opaque material or clear material, as desired. As discussed relative to containers 15, the containers 115 and 149 may be formed of suitable material, permitting their removal from the refrigerated environment to a heating environment, such as in an oven or the like. Similarly, the containers may be formed of suitable material permitting them to be placed on surface heating units. Still further, the containers may be formed of dishwasher-safe materials.

The door storage means of the invention provides virtually unlimited storage flexibility, permitting the use of substantially the entire inner surface of the refrigerator door, with a variety of different heights and capacity containers which may be covered or uncovered, as desired, and which may be readily removed from the door and utilized in further processing of the foodstuffs maintained refrigerated therein when the containers are stored on the refrigerator door. Thus, the containers may serve as conventional food storage, food preparation, and food serving containers, which may be readily washed as in conventional dishwashers, within the broad scope of the invention. By permitting the user to select the different sizes of containers desired in the door storage means, an accommodation to the user's preferences and needs in the use of the refrigerator is substantially improved.

The foregoing disclosure of specific embodiments is illustrative of the broad inventive concepts comprehended by the invention.

We claim:

1. In a refrigeration apparatus having wall means defining a refrigerated space having an access opening, and a door movably mounted to said wall means for selectively closing said opening in a closed position of the door, said door having an inner portion confronting said storage space in said closed position, the improvement comprising:

a storage container having a removable cover; housing means; and mounting means for fixedly associating said housing means with said door inner portion selectively in any one of a plurality of different locations, said housing means defining a front opening pocket for removably receiving and fittedly retaining said storage container on said door in said any one of a plurality of different locations.

2. The refrigeration apparatus of claim 1 wherein said housing means comprises means mounted on said door inner portion defining inwardly extending guides, and means on said container slidably received in said guides for removably guiding and supporting the container in the housing means and resultingly on the door.

3. The refrigeration apparatus of claim 2 wherein said guide means on the housing means comprises horizontally spaced, parallel sidewalls of said support means.

4. The refrigeration apparatus of claim 1 wherein said housing means comprises means mounted on said door inner portion defining inwardly extending guides, means on said container slidably received in said guides for removably guiding and supporting the container in the housing means and resultingly on the door, and releasable interlock means for retaining said container in a fully installed disposition in said housing means on said door.

5. The refrigeration apparatus of claim 1 wherein said housing means comprises means mounted on said door inner portion defining inwardly extending guides, means on said container slidably received in said guides for removably guiding and supporting the container in the housing means and resultingly on the door, and cooperating releasable interlock means on said container and housing means for retaining said container in a fully installed disposition on said door.

6. The refrigeration apparatus of claim 1 wherein said mounting means comprises a plurality of openings on the door, and means on said housing means removably engaeable with selected ones of said openings.

7. The refrigeration apparatus of claim 1 wherein said mounting means comprises a plurality of vertically spaced openings on the door, and means on said housing means removably engageable with selected ones of said openings.

8. The refrigeration apparatus of claim 1 wherein said mounting means comprises a plurality of openings on the door, and hook means on said housing means removably engageable with selected ones of said openings.

9. The refrigeration apparatus of claim 1 wherein said mounting means comprises a plurality of openings on the door, and means on said housing means removably engageable with in selected pairs of said openings.

10. The refrigeration apparatus of claim 1 wherein said mounting means comprises a plurality of openings on the door, and means on said housing means removably engageable with selected horizontally spaced pairs of said openings.

11. The refrigeration apparatus of claim 1 wherein a plurality of different height containers is provided and said container comprises any one of said plurality of containers.

12. The refrigeraton apparatus of claim 1 wherein said container is further provided with a front handle for use in manually sliding the container to and from said mounted association with said door.

13. The refrigeration apparatus of claim 1 wherein a plurality of said storage container and housing means are provided in side-by-side vertical arrays on said door.

14. The refrigeration apparatus of claim 1 wherein a plurality of said storage container and housing means are provided in side-by-side vertical arrays on said door arranged substantially fully over the entire inner portion of said door.

* * * * *